US010482758B1

(12) United States Patent
Nye et al.

(10) Patent No.: US 10,482,758 B1
(45) Date of Patent: Nov. 19, 2019

(54) DETECTING DESTRUCTION OF AN AUTOMATION SYSTEM COMPONENT

(71) Applicant: Vivint, Inc., Provo, UT (US)

(72) Inventors: James E. Nye, Alpine, UT (US); Jungtaik Hwang, Draper, UT (US)

(73) Assignee: Vivint, Inc., Provo, UT (US)

( * ) Notice: Subject to any disclaimer, the term of this patent is extended or adjusted under 35 U.S.C. 154(b) by 22 days.

(21) Appl. No.: 15/728,218

(22) Filed: Oct. 9, 2017

Related U.S. Application Data

(63) Continuation of application No. 15/173,710, filed on Jun. 5, 2016, now Pat. No. 9,786,156, which is a continuation of application No. 14/192,325, filed on Feb. 27, 2014, now Pat. No. 9,384,655.

(60) Provisional application No. 61/790,947, filed on Mar. 15, 2013.

(51) Int. Cl.

| | |
|---|---|
| ***G08B 29/00*** | (2006.01) |
| ***G08B 29/04*** | (2006.01) |
| ***G08B 29/10*** | (2006.01) |
| ***G08B 29/18*** | (2006.01) |
| ***G08B 29/06*** | (2006.01) |
| ***G08B 25/14*** | (2006.01) |

(52) U.S. Cl.
CPC ..... *G08B 29/046* (2013.01); *G08B 25/14* (2013.01); *G08B 29/06* (2013.01); *G08B 29/10* (2013.01); *G08B 29/183* (2013.01)

(58) Field of Classification Search
CPC ..... G08B 29/046; G08B 25/14; G08B 29/10; G08B 29/183; G08B 29/06; G08B 25/008; G08B 13/06; G08B 13/1436; G08B 13/1472
USPC ..... 340/506, 540, 541, 566, 568.1
See application file for complete search history.

(56) References Cited

U.S. PATENT DOCUMENTS

| | | | | |
|---|---|---|---|---|
| 4,480,480 | A * | 11/1984 | Scott | E02B 17/0034 702/41 |
| 6,011,465 | A | 1/2000 | Wang et al. | |
| 6,169,651 | B1 | 1/2001 | Dias et al. | |
| 8,395,494 | B2 | 3/2013 | Trundle et al. | |
| 9,384,655 | B2 | 7/2016 | Nye et al. | |
| 9,786,156 | B2 * | 10/2017 | Nye | G08B 29/06 |
| 2005/0219046 | A1 | 10/2005 | Noguchi et al. | |
| 2007/0085671 | A1 | 4/2007 | Martin et al. | |

(Continued)

FOREIGN PATENT DOCUMENTS

WO 2012166915 A1 12/2012

*Primary Examiner* — Anh V La
(74) *Attorney, Agent, or Firm* — Holland & Hart, LLP

(57) ABSTRACT

A control panel is used to monitor events within a security system or other automation system. In the event an intruder enters a physical location, the intruder may attempt to damage the control panel to disrupt its operation. One or more sensors of the control panel may detect disruption in the operation of the control panel. Example sensors may detect an impact force, sudden acceleration, removal from a mounted location, or disruption of communication with an input/output element, such as a display device. When an event is detected at the control panel itself, the control panel can send a signal to a remote service provider, and the remote service provider can follow-up with the customer. The control panel and/or remote service provider may also determine when the control panel loses partial or complete power loss to identify the disruption as a potential crash-and-smash entry.

18 Claims, 7 Drawing Sheets

(56) References Cited

U.S. PATENT DOCUMENTS

| | | | | |
|---|---|---|---|---|
| 2008/0079561 | A1 | 4/2008 | Trundle et al. | |
| 2011/0037593 | A1* | 2/2011 | Foisy ..... | G08B 25/001 340/540 |
| 2012/0133511 | A1 | 5/2012 | Blum et al. | |
| 2013/0082835 | A1 | 4/2013 | Shapiro et al. | |
| 2013/0321150 | A1 | 12/2013 | Koenig et al. | |

* cited by examiner

DETECTING DESTRUCTION OF AN AUTOMATION SYSTEM COMPONENT

CROSS-REFERENCE TO RELATED APPLICATIONS

The present application is a continuation of U.S. patent application Ser. No. 15/173,710, titled: "Detecting Destruction of an Automation System Component," filed on Jun. 5, 2016, which is a continuation of U.S. patent application Ser. No. 14/192,325, titled: "Detecting Destruction of an Automation System Component", filed on Feb. 27, 2014, which claims priority to U.S. Provisional Patent Application No. 61/790,947, titled: "Methods, Systems, and Devices for Detecting Destruction of an Automation System Component," filed on Mar. 15, 2013. The disclosures of each of which are incorporated by reference herein in their entireties.

TECHNICAL FIELD

The present disclosure relates to automation systems. More particularly, embodiments of the present disclosure relate to detecting destruction of components of an automation system. More particularly still, embodiments of the present disclosure relate to detecting when a control panel of an automation system is destroyed, and notifying a monitoring service of the destruction.

BACKGROUND

People are increasingly interested in providing security to a building. Security in a home setting may be particularly significant for a home owner or resident who is away from home, who has small children, or who keeps valuable items at the home. For such an owner or resident to feel secure, security and privacy may be provided through various security mechanisms. Example methods include using door and window locks, the use of video security cameras, or intrusion detection security systems. Some or all of these components may be automated, and potentially included as part of an automation system associated with one or more other functions.

In general, a security system may include multiple sensors to detect particular events, and to potentially control different devices. A door or window sensor may detect when a door or window is opened or broken. If the security system is armed, the sensor may send a signal that can be received by the control panel. The control panel may then sound an alarm and/or may communicate information about the detected event to a central monitoring, or back-end system. Such a system may use the received information to potentially contact an individual associated with the security system, to contact police or other emergency personnel, or to take other follow-up actions.

Criminals have been creative in determining how to enter a home or other location without the entry resulting in an alarm or a notification to the user and/or emergency personnel. One mechanism they use is the so-called "crash-and-smash" technique. This technique relies on the intruder entering the location and quickly finding the control panel. The intruder may then destroy the control panel before it has a chance to sound an alarm and/or alert a remote monitoring system of the entry. This technique is made easier in some cases as the control panel may delay sending a signal for a period of time. Because the control panel may not be able to detect the difference between an authorized person entering a location, and an unauthorized intruder entering the same location, the delay is provided to give the authorized person time to enter the location and disarm the device. This delay may be referred to as an "entry delay."

To attempt to combat this technique, some systems may detect an entry into a location, and immediately send a signal instead of waiting for the entry delay to expire. To allow an authorized person time to disarm the security system, the back-end system may wait for the entry delay to expire before taking action. As a result, an authorized person may enter and disarm the security system, which can trigger the control panel sending a signal to the back-end system that cancels the prior signal. If, however, a cancellation signal is not provided within the entry delay period, the back-end monitoring system may notify a user of the security system and/or emergency personnel. This system has, however, resulted in a significant number of false alarms. Providers of security systems receive an estimated hundreds of false alarms each day through such a system.

SUMMARY

In accordance with aspects of the present disclosure, embodiments of methods, systems, software, control panels, computer-readable media, and the like are described or would be understood and which relate to security systems and other types of automation systems. In accordance with some embodiments of the present disclosure, a security or automation system may be used in connection with a control panel. The control panel may communicate with automation components that detect events within the system. The control panel itself may also include components to detect events at the control panel. For instance, in the event of a crash-and-smash entry, the control panel may detect some disruption to the control panel. Before being rendered completely disabled, the control panel may communicate the detected disruption by sending a signal to a remote, back-end service provider. The service provider may then use the information to respond. Example responses may include contacting the user of the automation system, or contacting an emergency service provider.

The control panel may detect any number of types of disruptions prior to sending a signal to a back-end service provider. An example control panel may include an accelerometer or impact sensor that detects a force applied to the control panel itself. Upon detection of the force, or a force above a particular threshold, the signal may be sent to the back-end service provider. Another disruption event that may be detected includes detecting a display or other input/output device has been disabled, become non-functional, or lost communication. A control panel anti-tamper switch may detect when the control panel is removed from a mounted location, either in a graceful or forceful manner.

In accordance with some embodiments of the present disclosure, the control panel and/or back-end service provider may detect changes in power availability to the control panel. The control panel may include one or more sensors to detect the loss of access to AC, DC, or other power supplies. A first or second signal sent to the back-end service provider may include information indicating a loss of power. In some embodiments, the back-end service may respond only when a partial or complete loss of power is paired with another disruption event. In some embodiments, the back-end service provider may send a request to the control panel following a signal about a disruption event. If there is no response, it may be determined that there has been a complete loss of power, and follow-up procedures may be initiated. In other embodiments, the control panel may respond with power information indicating there has been no power loss or that only partial power loss has occurred at the control panel.

Additional embodiments of the present disclosure further relate to methods, systems, and devices associated with detection of crash-and-smash entries at a location. Such methods, systems, and devices may potentially be effective whether or not a security system or other automation system has been armed, and may include detection of a force or other disruption using components built into a control panel. Total or partial power loss may also be detected in order to determine whether to follow-up with the customer, or what type of follow-up measures to implement.

Other aspects, as well as the features and advantages of various aspects, of the present disclosure will become apparent to those of ordinary skill in the art through consideration of the ensuing description, the accompanying drawings and the appended claims.

BRIEF DESCRIPTION OF THE DRAWINGS

In order to describe the manner in which features and other aspects of the present disclosure can be obtained, a more particular description of certain subject matter will be rendered by reference to specific embodiments illustrated in the appended drawings. Understand these drawings depict only typical embodiments and, therefore, are not considered to be limiting in scope, nor drawn to scale for all embodiments, various embodiments will be described and explained with additional specificity and detail through the use of the accompanying drawings in which.

DETAILED DESCRIPTION

Systems, devices and methods of the present disclosure are configured for use in connection with residential and/or commercial buildings, or with other locations which may use an automation system. Without limiting the scope of the present disclosure, a home or business may have a security system installed to monitor use of the building, including entry into the home through a door, window, or other similar entry point. Sensors at the entry point may detect when the entry point is open, closed, or broken (e.g., a window broken) and can respond in different ways in response to a change in status. For instance, when the security system is armed, an alarm may sound if a door or window is opened. Optionally, police, security or other emergency personnel may be contacted respond to the event. Of course, the automation system may also include other security or safety components. For instance, if a leak in a water pipe is detected, the automation system may shut off a valve to prevent water from flooding the premise. If carbon monoxide is detected, an alert may be sent to a person occupying the building to alert them of the danger. In other embodiments, non-security components (e.g., HVAC, sprinkler systems, entertainment systems, etc.) may also be controlled using the automation system.

Figure 1:
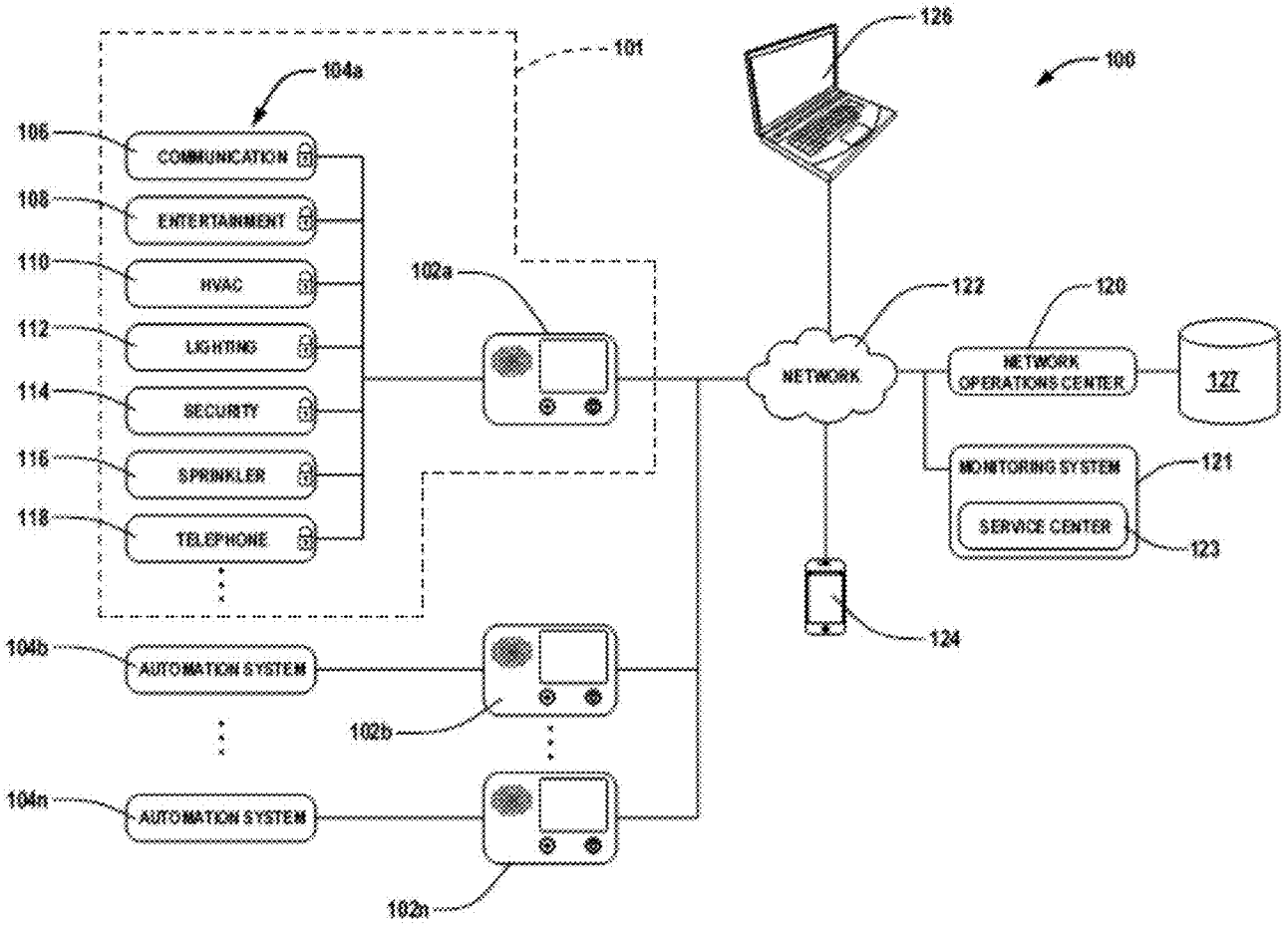
FIG. 1 is a schematic illustration of an example automation system, according to one embodiment of the present disclosure.

Turning now to FIG. 1, an example distributed system 100 is illustrated for allowing automating a physical location (e.g., a home, office, etc.) 101. The illustrated distributed system 100 may generally represent, or include, an automation system associated with the particular location 101. As part of such a distributed system 100, a control panel 102*a* may be used. The control panel 102*a* may, but need not necessarily, be located at the particular location 101 being monitored or controlled. For instance, in FIG. 1, the control panel 102 is located within a physical location 101 where other components of an automation system 104*a* are also located. Certain aspects of the distributed system 100, or the automation system 104*a*, may be administered through the control panel 102*a*, or the control panel 102*a* may be used to provide users with information about a status of the automation system 104*a*.

One aspect of the automation system 104*a* may be the ability to administer a security system 114 within the location 101. Accordingly, the automation system 104*a* may also be referred to herein as a security system. The automation system 104*a* may, however, include a number of different components, any or all of which may be used in connection with the control panel 102*a*. In this particular embodiment, for instance, the automation system 104*a* may include a communications system 106, an entertainment system 108, a heating, ventilation, and air conditioning ("HVAC") system 110, a lighting system 112, a sprinkler system 116, and/or a telephone system 118. Additional or other systems or components may also be included and monitored or controlled using the control panel 102*a*.

Any or all of the systems 106-118 may include sensors, controllers, valves, switches, or other components, or any combination thereof. Such components may be controlled or set using the control panel 102*a*, may be monitored using the control panel 102, may communicate with each other or the control panel 102*a*, or may have additional or other capabilities. Such components, which generally monitor or control some aspect of the physical location 101, may generally be referred to herein as "automation components." and may perform a variety of functions. For instance, a set of one or more automation components may be integrated as part of the security system 114 associated with the physical location 101. In some embodiments, the automation components of the security system 114 may include sensors that detect intruders (e.g., unauthorized opening of a door or window, breakage of a window, motion sensors, etc.), sensors that detect smoke or fire, or some other security-related component or a combination thereof. In some embodiments, the security system 114 may include automation components such as cameras which obtain still or video images of one or more locations.

Automation components of the automation system 104*a* may take any number of forms, and are not limited to security components. For instance, automation components may include entertainment components such as televisions, recordable media players (e.g., DVD player, Blu-Ray Player, digital video recorders, VCR, set-top box, etc.), projectors, speakers, stereos, and the like, or controllers therefor, any or all of which may be separate from the control panel. Such entertainment components may be used, by way of example only, to turn on a television, radio, optical disk player, to change a channel or volume of television or radio, or for other purposes. In the same or other embodiments, automation components may include thermostats, air conditioners, furnaces, temperature sensors, and the like, or controllers therefor. Monitored and/or controllable automation components may further include lighting system components such as light fixtures, switches, motion sensors, etc. to monitor the status of lights and/or to turn lights on or off. Still other automation components or controllers, or may include security system components including sensors or detectors (e.g., motion sensors, magnetic sensors, intrusion sensors, vibration sensors, infrared sensors, ultrasonic detectors, microwave detectors, contact sensors, photoelectric beam detectors, smoke detectors, temperature sensors, carbon monoxide detectors, etc.), video or still cameras, speakers, microphones, or other components. In embodiments where the automation system 104*a* includes a sprinkler system 116, the automation components may include valves, actuators, sensors (e.g., flow rate sensors, proximity sensors, etc.), sprinklers, pumps, and the like. In a similar manner, where one or more of the automation components is part of a telephone system 118, the automation components may include telephones, answering machines, call forwarding components, intercoms, and the like. Some or all of the automation components of the various systems 106-118 may also include wireless communication system components. As an example, the automation components may include routers, switches, access points, repeaters, bridges, and the like.

When a particular event occurs at the control panel 102*a* or at a monitored automation component, the control panel 102*a* may receive an indication of the event and cause other automation components to respond. Additionally or alternatively, the control panel 102*a* may communicate with components, including those remote from the physical location. As an example, upon monitoring the automation components of the systems 106-118, the control panel 102*a* may detect changes in status, which may correspond to events. For instance, as discussed herein, if the security system 114 includes an automation component at a front entry door, the automation component may change status when the door is opened, closed, broken down, or the like. A signal representing the changed state may be sent to the control panel 102*a*, which may identify the event that occurred, and potentially the location (e.g., the front entry) of the event. If the security system 114 is armed, opening of the door may be recognized as an event associated with an intruder entering the building. The control panel 102*a* may be programmed to respond accordingly. For instance, the security system 114 may include an alarm automation component. The control panel 102*a* may turn on the alarm of the alarm automation component. Of course, the control panel 102*a* may also perform other actions, including initiating a phone call to the police or security (e.g., using the telephone system 118 or a radio component built into the control panel 102*a*). In the event of another type of event—whether detected using the security system 114 or another of the systems 106-118—the control panel 102*a* may facilitate taking of other actions.

In one embodiment, such as where the security system 114 is armed and a potential intruder is detected, the control panel 104*a* may initiate an alarm immediately, although in other embodiments, there may be a delay. Such a delay, which may be considered an entry delay, may allow an authorized person to enter the location and have time to disarm the security system 115 by entering a code into the control panel 102*a*.

In at least some embodiments, the control panel 102*a* may communicate with one or more third parties. For instance, FIG. 1 illustrates the control panel 102*a* as being in communication with a network operations center ("NOC") 120 and/or a monitoring system 121, either or both of which may act as a back-end or central monitoring system. Either or both of the NOC 120 and monitoring system 121 may further be in communication with a data store 127. The data store 127 may store any number of types of information. For instance, the data store 127 may store customer data (e.g., contact information, billing information, associations between control panels and customers, etc.), response information (e.g., protocols for responding to an event), service records, or the like.

Optionally, the control panel 102*a* may provide the NOC 120 or monitoring system 121 with information about detected events. In some cases, the information may be acted upon by the NOC 120 or monitoring system 121. By way of illustration, if the control panel 102*a* notifies the NOC 120 that an armed door has been opened, which may correspond to a potential intruder, the NOC 120 may respond by contacting the owner, resident, or tenant of the location 101, or by notifying police or security. Consequently, the NOC 120 or monitoring system 121, rather than by the control panel 102*a*, may take some actions in response to a detected event. As discussed in more detail herein, one example may include responding following receipt of a signal from the control panel 102*a*, which signal may indicate a security event occurred and/or that the control panel 102*a* lost power or otherwise had its operation disrupted in some manner. The NOC 120 and/or monitoring system 121 may also respond to other signals indicating other types of events.

In accordance with some embodiments of the present disclosure, the monitoring system 121 includes, or is associated with, a service center 123. The service center 123 may include computing devices and/or personnel who respond to events identified in any of numerous automation systems 104*a*-104*n*. In the example of a potential intruder at the location 101, the monitoring system 121 may receive some notice of the event and pass information about the event to the service center 123 (e.g., send an electronic message including information about the event, where the event is located, contact information for a user of the automation system 104*a*, etc.). The service center 123 may then be used to follow-up with the user of the automation system 104*a* to ask if they need assistance, to alert them of what was detected, to contact emergency personnel, or for any number of other actions. The actions taken may be automated (e.g., automatic email or text message notifications) or may performed manually by a human operator (e.g., a customer service representative may call a phone number to check-in on the customer). Actions may also include a combination of automated and manual actions. For example, the monitoring system 121 may automatically send an electronic communication to the service center 123, which may use a computing device to notify a customer service representative of the event. The representative may dial and call the customer, or the service center 123 may have an auto-dialer to make the call. When the customer answers, the representative may talk with the customer. Although the monitoring system 121 is shown as being separate from the NOC 120, in other embodiments, the NOC 120 may include some or all operations of the monitoring system 121. The service center 123 may also be included as part of the NOC 120, or separate therefrom, and may also be separate from a monitoring system 121.

In general, actions taken by the NOC 120, monitoring system 121, or a human operator may include "in-band" or "out-of-band" actions. For instance, some responses may be "in-band" responses where an action is taken using the control panel 102*a*. As an example, the NOC 120 or monitoring system 121 may send information back to the control panel 102*a* for display, or a human operator may initiate voice communication through the control panel 102*a*. In other embodiments, the response may include actions taken without the use of the control panel 102*a*. Such actions may generally be referred to as "out-of-band" responses. For instance, after detecting an intruder, a phone call may be made to police or security to request that they monitor the location where the intruder was detected. A phone call may also be placed to the user or owner of the automation system 104*a*. As an example, the NOC 120 may place a call to a telephone 124, send an email retrieved at the computing device 126, or otherwise initiate some communication or action that does not pass through or otherwise use the control panel 102*a*.

To allow the NOC 120 and/or monitoring system 121 to be aware of detected events, and to potentially respond to such events, the control panel 102*a* may communicate with the NOC 120 or monitoring system 121 through a communications network 122 of the distributed system 100. The communications network 122, which may carry electronic communications, may include the Internet, local area networks, wide area networks, virtual private networks ("VPN"), telephone networks, long-range wireless networks, mobile networks, other communication networks or channels, or any combination of the forgoing. Thus, it should be understood that the communications network 122 may operate in any number of different manners, and can include different components, and may be distributed so as to include different components at different locations. For instance, the communications network 122 may include a wireless communication system such as that provided by a mobile phone provider. As an example, the control panel 102*a* may include a radio component to communicate with or using the communications network 122 through long-range wireless signals, mobile telephone signals (e.g., GSM, CDMA, LTE, HSPA+), or other technologies, or any combination of the foregoing. In other embodiments, other wireless systems or even wired communication may be used in addition to, or instead of, other technologies. Thus, the communications network 122 may include multiple devices, components, systems, or technologies. For example, the communications network 122 may include multiple networks interconnected to facilitate communication.

The NOC 120 or monitoring system 121 may optionally be used for other or additional purposes beyond responding to events detected by the automation system 104*a*. For instance, the NOC 120 or monitoring system 121 may be a central monitoring location for use with multiple control panels 102*a*-102*n*. Indeed, monitoring may be performed for any number of control panels 102*a*-102*n*, each of which may be connected to its own automation system 104*a*-104*n*. Further, the NOC 120 and/or monitoring system 121 may update software or firmware on the control panels 102*a*-102*n*, and ensure the control panels 102*a*-102*n* are operating and communicating properly with automation components of their respective automation systems 104*a*-104*n* and/or with the NOC 120 or monitoring system 121.

The distributed system 100 of the present disclosure may be implemented as a communication system in which the operations of various systems and components may be monitored through communication links. As discussed herein, such communication links may include wired or wireless links, or may include a combination of wired and wireless links, any or all of which may use different protocols or networks. Regardless of the particular mode of communication, the status or operation of devices and components can be reported to, or controlled using, the corresponding control panel 102*a*, NOC 120, monitoring system 121, or even other electronic devices 124, 126. For instance, the electronic devices 124, 126 may interact with the monitoring system 121 to monitor and/or control aspects of the automation systems 104*a*-104*n*. The NOC 120 and/or monitoring system 121 may, for instance, provide a remote access system. Using the remote access system, a user may utilize a browser or application on a computing device (e.g., computing device 126, mobile phone 124) to interact with the NOC 120 or monitoring system 121, which may in turn communicate with the control panel 102*a* to monitor or control aspects of the automation system 104*a*. In other embodiments, a remote access system may be provided by, or in connection with, the control panel 102, so that a remote computing device may communicate directly with the control panel 102*a* via the network 122.

The control panel 102*a* may be equipped to use one or more different communication protocols in communicating with automation components of the automation system 104*a* and with the communication network 122. Such communication protocols may be implemented using any combination of one or more of wired or wireless communication. As an example, automation components of the automation system 104*a* may operate using a wireless protocol, or system that allows a mesh network to be formed. Each automation component may, for instance, optionally be able to communicate with some or any other automation component, provided they are in range of each other. If the automation components use a wireless system for communicating with the control panel 102*a*, an automation component that is in range of the control panel 102*a* may send information to, or receive information from, the control panel 102*a*. In some embodiments, the automation components may communicate with each other and the control panel 102*a* using the same communication protocol. Although not intended to limit the scope of the present disclosure, an example communication protocol for such an embodiment may be a low power, short range wireless communication protocol (e.g., Z-Wave, ZigBee, etc.). In other embodiments, larger range wireless communication protocols (e.g., WiFi, LightwaveRF, etc.) may be used in addition to, or instead of, the shorter range alternatives. Such connections may allow two-way communication or may provide only one-way communication.

The control panel 102*a* may also optionally communicate with the communication network 122 and/or the NOC 120 or electronic devices 124, 126 using the same or other protocols. As an example, if the electronic device 124 is in sufficiently close physical proximity to the control panel 102*a*, a physical connection may be used, or a suitable wireless communication protocol (e.g., Z-Wave, ZigBee, Bluetooth, WiFi, etc.) may be used.

Communication with the communication network 122 may be made in any suitable manner, including using wireless or wired communication, or a combination thereof. For instance, as discussed herein, an example control panel 102*a* may communicate with a network 122 operating on a mobile telephone system. A GSM, CDMA, LTE, HSPA+, or other similar wireless communication component may therefore be included in the control panel 102*a* and the network 122 to allow for such communication. In other embodiments, the network 122 may have other components to allow for alternative or additional types of communication between the network 122 and the control panel 102*a*. Moreover, a NOC 120 may communicate with different control panels 102*a*-102*n* of different automation systems 104*a*-104*n* using the same or different communication protocols, and potentially allow such control panels 102*a*-102*n* to communicate with each other.

Figure 2:
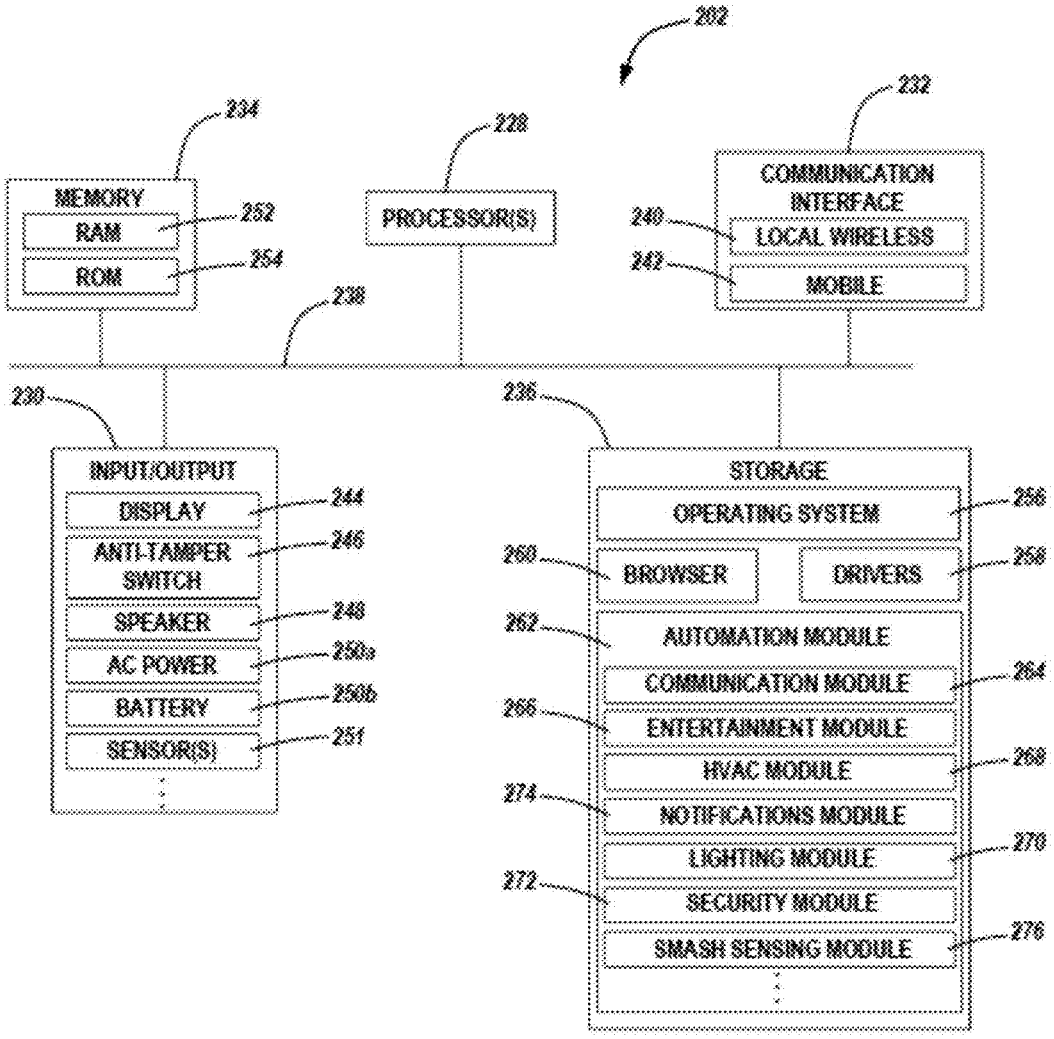
FIG. 2 is a schematic illustration of an example control panel usable in an automation system, according to one embodiment of the present disclosure.

Turning now to FIG. 2, an example control panel 202 is schematically illustrated. It should be appreciated in view of the disclosure herein that the control panel 202 may be used in the distributed system of FIG. 1 or in connection with any of a variety of other systems. The illustrated control panel 202 is merely illustrative, and a control panel of the present disclosure may have fewer or additional components, or elements other than those expressly described or illustrated, or may be used in connection with systems or components other than those of FIG. 1 or the methods, systems, and devices disclosed herein.

In FIG. 2, the control panel 202 includes multiple components interacting together over one or more communication channels. In this embodiment, for instance, one or more processors 228 may communicate with input/output devices 230, a communication interface 232, memory 234 and/or a mass storage device 236 via a communication bus 238. The processors 228 may generally include one or more processing components, including a central processing unit, a graphics processing unit, or the like, any of which may be capable of executing computer-executable instructions received or stored by the control panel 202.

The processors 228 may communicate with the communication interface 232 using the communication bus 238. The communication interface 232 may receive or send communications via one or more networks (e.g., network 122 of FIG. 1) or otherwise communicate with other components or devices (e.g., automation system 104*a* of FIG. 1). Received communications may be provided over the communication bus 238 and processed by the processors 228.

In the particular embodiment illustrated in FIG. 2, the communication interface 232 may include multiple components to allow communication via one or more different protocols. For instance, the illustrated embodiment includes an interface component 240 for connecting to local components, such as over a wireless mesh network. As discussed herein, an example of the component 240 may include radio which operates using Z-Wave, ZigBee, or other protocols, or some combination thereof. Such a component may specifically be used to communicate with security or other automation system components for a residence or other structure, including one or more sensors, cameras, controllers, and the like. Further, while a single local wireless interface component 240 is shown, such a component may include multiple elements, including antennas. In some embodiments, for instance, the interface component 240 may include multiple antennas to communicate with multiple automation components simultaneously, and potentially using any of a variety of different frequencies or channels.

In still another example embodiment, an example communication interface 232 may include an interface component 242 for communicating over a long-range wireless network, a mobile telephone network, or another type of wireless or wired network, or some combination thereof. An example network may include, for instance, GSM, CDMA, LTE, HSPA+, or other communication typically used by a wireless carrier to communicate with a mobile device such as a telephone or tablet computing device. As discussed herein, in one example embodiment, the interface component 242 may be provided to facilitate communication between the control panel 202 and a network operations center (e.g., NOC 120 of FIG. 1) or other back-end service provider (e.g., monitoring system 121 of FIG. 1).

In still another embodiment, the communication interface 232 may include other components. For instance, an example control panel 202 may be used to send and/or receive communications over a wireless protocol such as WiFi (i.e., IEEE 802.11), Bluetooth, or some other protocol. The local wireless interface component 240 may, for instance, include WiFi or other similar capabilities. Moreover, according to some embodiments as disclosed herein, the interface component 240 may be configured to allow the control panel 202 to function as a wireless access point.

According to some embodiments, the control panel 202 may include one or more input/output devices 230. In FIG. 2, the input/output devices 230 may communicate with one or more processors 228 using the communication bus 238. Any suitable type of input/output device may be provided. For instance, a control panel 202 may include buttons, keypads, voice recognition components, or the like through which input is received from a user. A display 244 may also be provided and used as an output to display information to a user. In some embodiments, the display 244 may also act as an input. For instance, the display 244 may be a touch-sensitive display allowing a user to touch the display 244 to make a selection, to provide input through a gesture, or to otherwise provide input. Still other types of input or output devices may include an anti-tamper switch 246, audio output devices such as a speaker 248, power components (e.g., an AC power input 250*a* or batteries 250*b*), or one or more sensors 251. Example sensors may include sensors to detect power capabilities (e.g., whether AC power or battery power has been lost, whether power to the display 244 or another component has been interrupted, etc.). Another sensor, as described herein, may include an impact or shock sensors. Such a sensor may include an accelerometer or other component that may detect changes in forces on the control panel 202. Thus, if a control panel 202 is dropped, hit (e.g., in a crash-and-smash scenario), or the like, the impact to the control panel 202 may be sensed. The illustrated input/output devices 230 of a control panel 202 are merely illustrative. In other embodiments, for instance, a port, trackball, mouse, biometric reader (e.g., iris scanner, fingerprint reader, etc.), GPS device, or other component, or some combination of the foregoing, may be included.

The control panel 202 may also include memory 234 and mass storage 236. In general, the memory 234 may include one or more of persistent and non-persistent storage, and may store computer-executable instructions that may be executed by the processors 228, data, or other information. In the illustrated embodiment, the memory 234 is shown as including random access memory (RAM) 252 and read only memory (ROM) 254, although other or additional types of memory or storage may also be included.

Generally, the mass storage 236 may comprise of persistent storage in any of a number of different forms. Such forms may include a hard drive, flash-based storage, optical storage devices, magnetic storage devices, or other forms which are either permanently or removably coupled to the control panel 202. In some embodiments, an operating system 256 may define the general operating functions of the control panel 202, which may be executed by the processors 228. The operating system 256 may be stored in the mass storage 236, although all or a portion of the operating system 256 may alternatively be stored in the memory 234. Other components stored in the mass storage 236 may include drivers 258 (e.g., to facilitate communication between the processors 228 and the input/output devices 230 and/or components of the communication interface 232), a browser 260 (e.g., to access or display information obtained over a network, including mark-up pages and information), and/or application modules.

Application modules may generally include any module, program, or application that may be used in connection with the operation of the control panel 202. Examples of application modules may include programs specifically designed for use with a security and/or automation system (e.g., automation module 262), or more general use programs, applications, or modules. Examples of more general use applications may include word processing applications, spreadsheet applications, games, calendaring applications, weather forecast applications, sports scores applications, and other applications.

As shown in FIG. 2, in at least one embodiment, the automation module 262 may include, or operate in connection with, additional modules or components capable of being used by the control panel 202 in connection with a security or automation system. For instance, the automation module 262 may include an additional communication module 264. Such a communication module 264 may generally be used to control or monitor how one or more communication systems of a residence or commercial building operate. For example, an intercom system may be provided at an entry to the building, and the communication module 264 may monitor its use and potentially be used in passing communications (e.g., using a speaker or sending communications to a remote device). The communication module 264 may similarly be configured to facilitate visual communications (e.g., using one or more cameras and/or visual display devices). Moreover, the communication module 264 may be used to determine when to allow communication.

The illustrative automation module 262 is also shown as including an optional entertainment module 266, HVAC module 268, and lighting module 270. The entertainment module 266 may generally monitor and/or control entertainment-related devices and functions of a location. For instance, the channel or volume of a television may be monitored and potentially changed using the control panel 202. The HVAC module 268 may generally monitor or control heating or air conditioning components. For instance, if the temperature in a location is higher or lower than desired, the HVAC module 268 may control a thermostat to obtain a more comfortable temperature. Similarly, the lighting module 270 may monitor, control or otherwise interface with lighting components including switches, lighting fixtures, and the like. In some embodiments, such as where a light is provided at an entry way, the lighting module 270 may interface with sensors used to detect the presence of a person (e.g., a motion sensing light). The lighting module 268 may also perform other functions (e.g., automatically turn on a light in response to a trigger event).

The modules 272-276 may provide additional and potentially similar functions. For instance, the security module 272 may interface with security-based automation components, such as security sensors and automation components (e.g., motion sensors, magnetic sensors, intrusion sensors, vibration sensors, infrared sensors, ultrasonic detectors, microwave detectors, contact sensors, photoelectric beam detectors, smoke detectors, temperature sensors, carbon monoxide detectors, etc.). When an event is detected, the security module 272 may determine whether to sound an alarm, how the control panel 202 should respond to the event, what communications to send to a NOC or other remote location, and/or other actions to take.

The notifications module 274 may have other functions. For example, in response to some events, providing information to a remote or other third party may be desirable. For example, a NOC or other remote service provider may be sent information about an event. The remote system may then respond to the control panel 202 for some in-band action, or take other actions out-of-band. In some embodiments, the notifications module 274 may be used to send signals, messages or other notifications to a remote system or to receive communications from the remote system. The notifications module 274 may also be capable of interpreting messages, preparing reports on events or notifications, providing reports on the status of automation components, and the like. Such a report may be prepared periodically or in response to a particular event. In one embodiment, an event may trigger a report defined by the notifications module 274, which may be provided to a remote system using the communication interface 232.

The automation module 262 may also include other components or modules, including a tamper monitoring module 276. In at least some embodiments, the smash sensing module 276 may detect the occurrence of an impact or other potentially destructive force or event at the control panel 202. For instance, the smash sensing module 276 may monitor an anti-tamper switch 246 or sensor 251 of the input/output devices 230. When the switch 246 is activated, or when an accelerometer 251 or other sensor indicates that a shock or impact has been applied to the control panel 202, the shock sensing module 276 may determine a control panel event is occurring. In some cases, the shock sensing module 276 may operate in connection with the notifications module 274 and/or communication interface 232 to communicate information about the event to a NOC or other remote service provider. In some embodiments, the shock sensing module 276 may monitor other components in addition to, or instead of, the anti-tamper switch 246 or a sensor 251. For instance, as discussed herein, a person may attempt to destroy the control panel 202 by, among other things, removing the ability of the control panel 202 to access AC or DC power. In one embodiment, the shock sensing module 276 may therefore also monitor an AC power component 250*a*, battery power source 250*b*, or some other component usable to provide power to the control panel 202.

The foregoing description and the modules shown in FIG. 2 are purely provided to illustrate the variety of different types of modules, programs, or applications that may be included, and are not intended to be an exclusive list. In other embodiments, for instance, additional modules may include a remote access module. Such a module may, for example, enable the control panel 202 to be directly accessed using remote devices (e.g., devices 124, 126 of FIG. 1), and to potentially have communications relayed through the control panel 202 either to or from the remote devices. In other embodiments, however, remote access may be enabled through a web portal, NOC, monitoring system, or other system, and managed by the remote access module. Thus, a user of a remote device could potentially set or view communications, door cameras, entertainment, lighting, security, HVAC, sprinkler, telephone, or other settings remotely, or even receive or otherwise monitor audio or video feeds from a remote location.

The automation module 262 may also include additional or other modules or components, including modules not shown in FIG. 2. For instance, the automation module 262 may include a sprinkler system module (e.g., to verify water flow rates at one or more locations, turn sprinklers on or off, etc.), a telephone module (e.g., to interface with a telephone system and potentially run telephone calls through the control panel, to forward calls, etc.), an updating module (e.g., to pull or request software updates), and the like. In other embodiments, modules may be included and which relate to authentication, settings, preferences, encryption/decryption, an emergency override, or other uses.

Turning now to FIGS. 3A-3D, an example control panel 302 is illustrated in additional detail. The control panel 302 may include some or all of the components or capabilities of the control panels described relative to FIGS. 1 and 2, or may include still other or additional features. The particular control panel 302 is illustrated to describe one mechanism for detecting a destructive event at the control panel 302. For instance, the control panel 302 may detect when a "smash" event occurs during a crash-and-smash entry into a building or other secured location. By detecting the event, the control panel 302 may potentially report the event to a NOC or other remote service provider prior to being rendered completely inoperable.

Figure 3A:
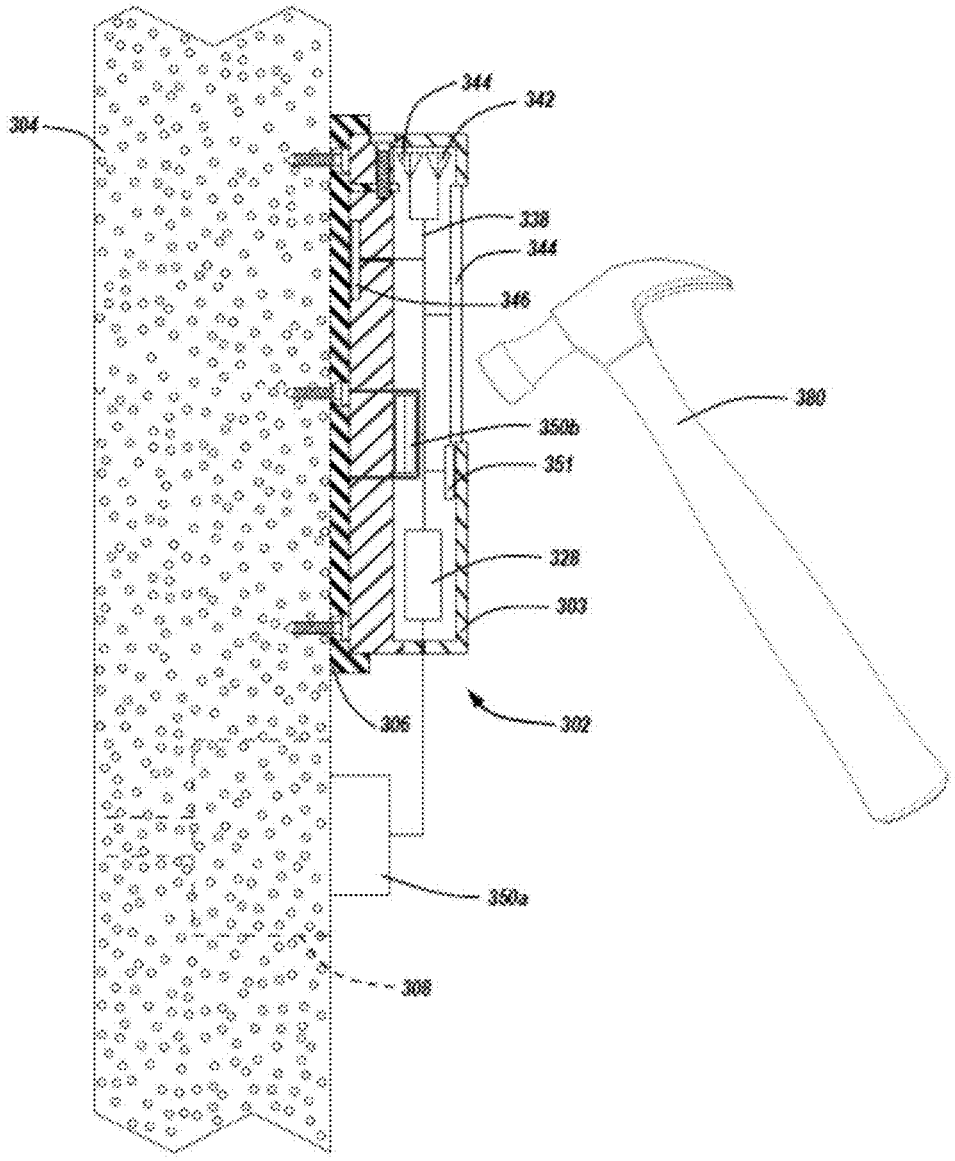
FIG. 3A illustrates a cross-sectional view of a control panel mounted to a wall or other mounting surface, with some components of the control panel schematically illustrated, according to one embodiment of the present disclosure.

The control panel 302 can include a variety of components or features, some of which are schematically illustrated in FIG. 3A. In particular, the control panel 302 may include one or more interface components, such as a display 344. Using the display 344, information may be communicated about the control panel 302 and/or a connected automation system. Other interface features, including speakers, buttons, ports, and the like are omitted to avoid unnecessarily obscuring aspects of the disclosure, but may also be included in the control panel 302.

The control panel 302 may communicate with local automation components and/or remote service providers using one or more antennas 342, 344. In some embodiments, a set of one or more antennas 342 may communicate with local automation components within an automated location. Example systems and protocols are discussed herein, and may include, but are not necessarily limited to, use of wireless mesh network protocols. The antenna 344 may also communicate with local automation components. In other embodiments, however, the antenna 344 may include one or more antennas to communicate with a remote service provider. The antenna 344 may include components or features described herein, including features and components for communicating using a mobile phone communications network, a long-range wireless network, or other wireless or wired communication network.

Additional features of the control panel 302 may include a controller 328. The controller 328 may include one or more processors and/or other components for operating the control panel 302. In one embodiment, the controller 328 may include a printed circuit board or other similar component, along with storage devices, processors, and the like. Such a controller 328 may be used to interpret signals received via the antennas 342, 344, input received via the display 344 or other input/output components, or to send signals to the same or similar components. A communication link 338 may be connected to the controller 328 to allow such communication among the various components of the control panel 302.

One or more sensors or switches may also be in communication with the controller 328. In FIG. 3A, for instance, an anti-tamper switch 346 may be included as one type of sensor in communication with the controller 328 and/or the antennas 342, 344. The anti-tamper switch 346 may be specifically configured to determine when the control panel 302 is removed from the wall 304 or another mounting surface. In FIG. 3A, for instance, a mounting plate 306 is secured to the wall 304, and the control panel 302 is then secured to the mounting plate 306. The anti-tamper switch 346 may detect when the control panel 302 is removed from the mounting plate 306 and/or the wall 304.

The illustrated control panel 302 may include a sensor 351. The sensor 351 may detect any of a number of different conditions with respect to the control panel 302. For instance, the sensor 351 may include an accelerometer or other shock sensor within a body 303 of the control panel 302. If a force is applied to the control panel 302, the sensor 351 may measure the force. For instance, FIG. 3A illustrates a hammer 380 that may hit the control panel 302. Upon the body 303 receiving the impact from the hammer 380, the sensor 351 may detect the impact, and potentially quantify or categorize the impact. For instance, impacts of a short duration, but a large force, may be determined to be of one type (e.g., a potential "smash" scenario). Impacts of longer duration or lesser force may be associated with other events. For instance, if a control panel is dropped, the force profile may show multiple impacts of decreasing intensity as the control panel 302 bounces on a floor. An earthquake may also cause the sensor 351 to detect a force, but the profile may be significantly different in length and/or intensity relative to a force specifically intended to destroy or incapacitate the control panel 302. Classifying forces, including duration or quantity, is merely optional. In another embodiment, for instance, any impact force over a threshold level may be sensed and potentially reported to a remote service system.

The sensor 351 may include a single sensor or multiple sensors. For instance, if the sensor 351 includes an accelerometer or other shock sensor, the sensor 351 may also include additional sensors for other purposes. An example sensor may detect power conditions at the control panel. For instance, one or more power supplies may be provided to allow the controller 328, display 344, antennas 342, 344, sensors 346, 351, and other components to operate. The power supplies may include an AC power supply **350*a* and DC power supply 350*b*. If power supply from any supply is lost, the sensor 351 may detect the loss, so that it may potentially be acted upon by the control panel 302 and/or a remote service system. In one embodiment, for instance, the DC power supply 350*b* may include batteries that run out of power. The sensor 351 may detect when the batteries are dead, and can cause the control panel 302 to display a notice suggesting battery replacement. Of course, AC, DC or other power may be lost when the control panel is destroyed, and the sensor 351** can detect power lost during such a scenario.

With particular reference to the control pane 302 of FIG. 3A, the AC power supply **350*a* may have any number of configurations. For instance, the AC power supply 350*a* may include a plug or other connector configured to connect to an AC power source. In this particular embodiment, the AC power source may include an outlet 308 in the wall 304, although an outlet 308 may be located in any suitable location. The plug of the AC power supply 350*a* may connect to the outlet 308 to access the power source. If the plug is removed, or if a wire or other electrical connection is cut, AC power to the control panel 302 may be cut off. As also noted herein, the DC power supply 350***b* of the illustrated embodiment may include a DC voltage source such as a battery or set of batteries. The illustrated DC power supply 350*b* is shown as being embedded within the body 303 of the control panel 302, although such a power supply may be removable. In some embodiments, the DC power supply 350*b* and AC power supply 350*a* may each power some components of the control panel 302. In other embodiments, the one of the DC power supply 350*b* or AC power supply 350*a* may provide primary power to all or some components, while the other may act as a backup power source. For instance, the AC power supply 350*a* may primarily be used for power; however, the DC power supply 350*b* may provide power in the event the AC power supply 350*a* is unplugged, damaged, disconnected, or otherwise fails to provide the necessary power.

Although a hammer 380 is shown in FIG. 3A as one device capable of applying a force to the control panel 302, and potentially damaging the control panel 302, an impact force capable of damaging the control panel 302 may occur in any number of manners. For instance, an intruder to a building or location may have a crowbar, baseball bat, or any other object that can strike the control panel 302. Such devices may be capable of damaging some or all of the components of the control panel 302, and potentially rendering the control panel 302 inoperable. An impact could also occur simply by hitting the control panel 302 with a hand or shoe, or by dropping the control panel 302. Thus, embodiments of the present disclosure may detect impact forces occurring in any number of manners.

Regardless of the manner in which an impact or shock force occurs, and whether the force is intentional or unintentional, the force may be capable of damaging the control panel 302. Such damage may be minor or may be significant. Indeed, in some embodiments, the force may be intended to completely incapacitate the control panel 302. For example, an intruder may perform a crash-and-smash entry and try to destroy the control panel 302 before an alert or alarm can be produced.

Figure 3B:
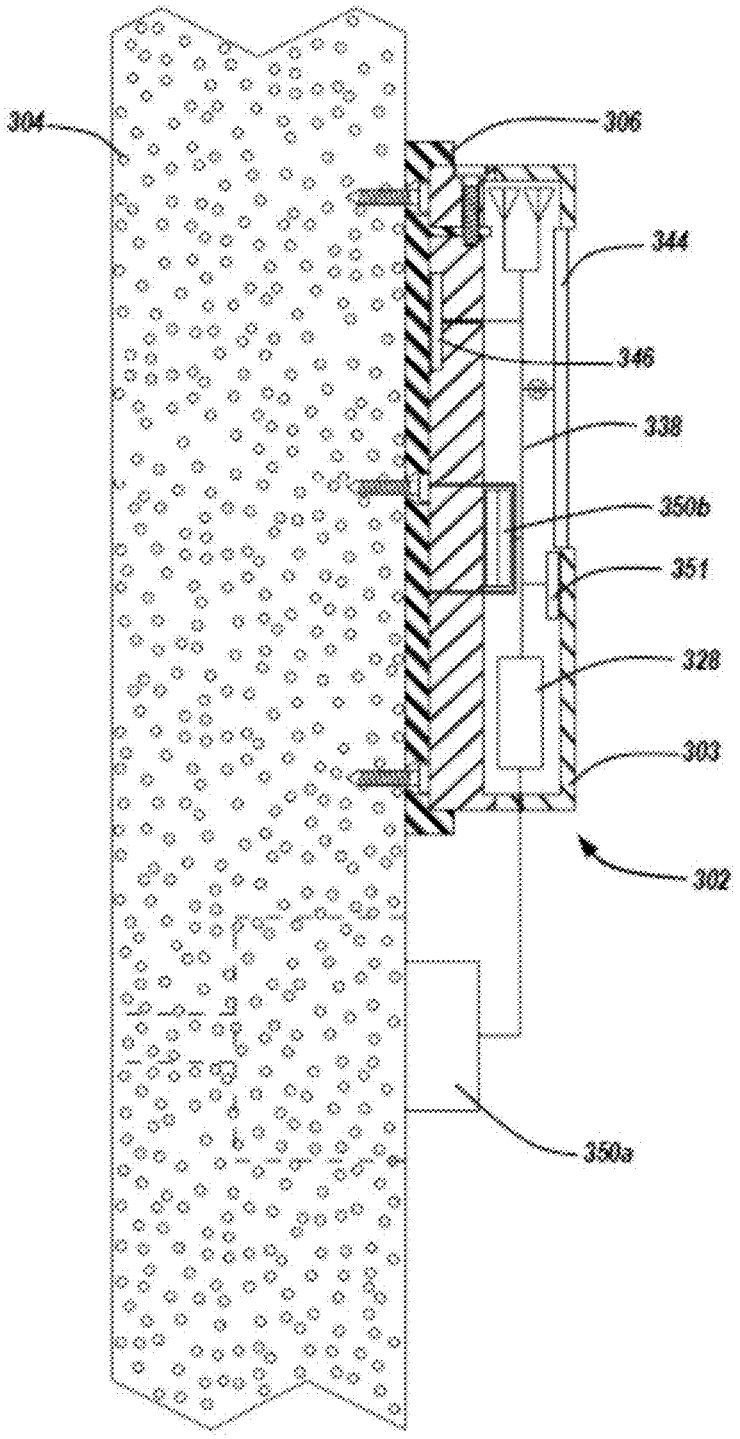
FIG. 3B illustrates a cross-sectional view of the control panel of FIG. 3A, and represents a potential destruction of the control panel in which communication between one or more components may be interrupted, according to one embodiment of the present disclosure.

In some embodiments, the damage to the control panel 302 may be sensed by the control panel. For instance, turning now to FIG. 2, the communication link 338 is shown as extending between the controller 328 and the various other components of the control panel 302. When the control panel 302 is hit with an impact force, damage may include severing communications between some or all components. For instance, FIG. 3B illustrates an embodiment in which communication with the display 344 may be interrupted (as shown schematically). If the display 344 is damaged, or if the electrical connections with the display 344 are severed, the controller 328 may be unable to continue communicating with the display 344. The sensor 351 may potentially detect when power to the display 344 is lost. In such an event, the control panel 302 may send a message or signal to a remote service center indicating that the control panel 302 has been damaged, as discussed in greater detail herein.

While FIG. 3B illustrates an embodiment in which communication with the display 344 may be lost, an impact force to the control panel 302 may cause other damage. For instance, the impact force may break the body 303, interrupt other communications, break audio components, destroy buttons or input devices, or have other effects. Such effects may be detected by the sensor 351 and/or anti-tamper switch 346. In some embodiments, the detection may occur rapidly, and a signal about the detected event may be sent using the antennas 342, 344 before the control panel 302 can be completely disabled.

Figure 3C:
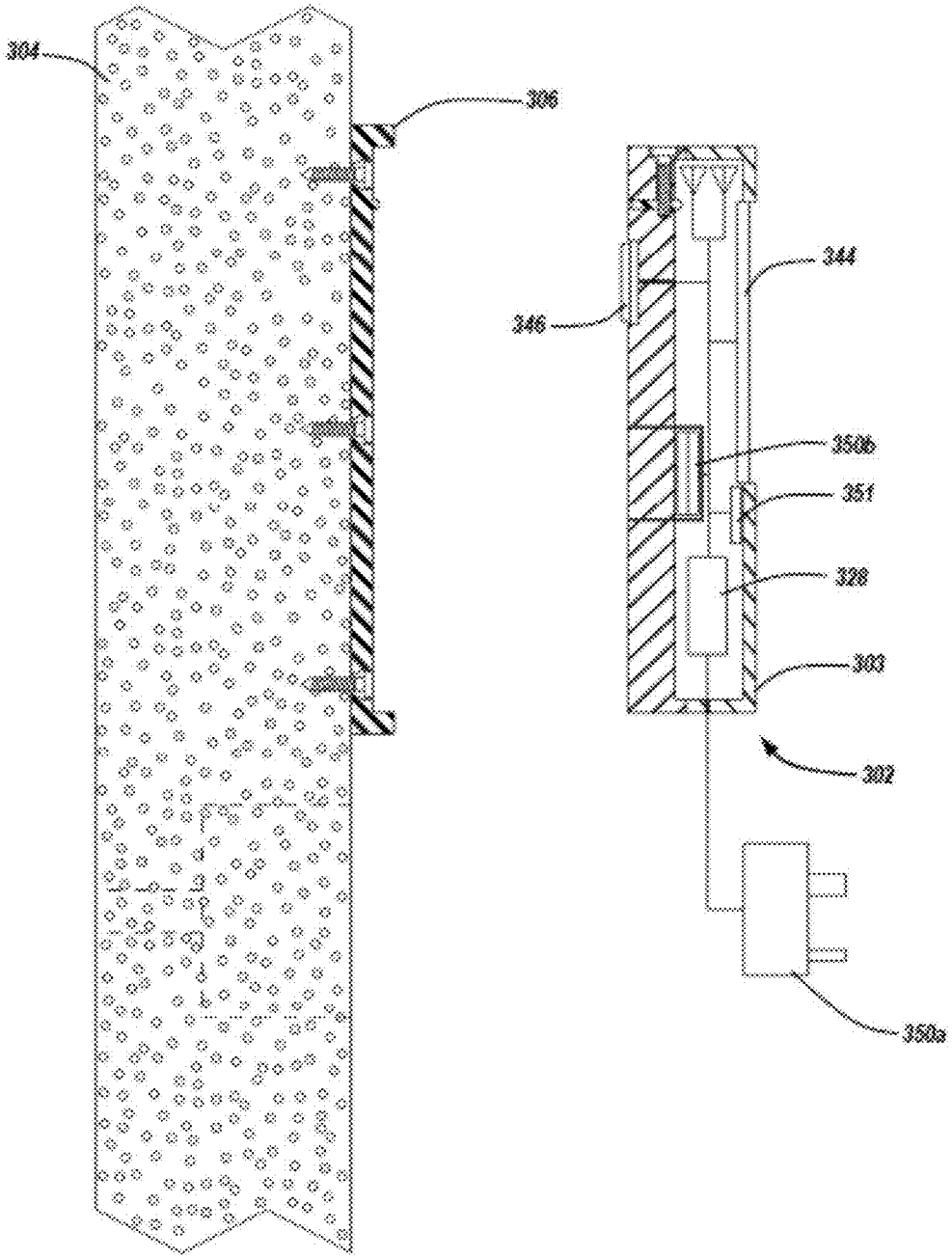
FIGS. 3C and 3D illustrate cross-sectional views of the control panel of FIG. 3A when removed from a mounting surface, in accordance with some embodiments of the present disclosure.

FIG. 3C illustrates a similar scenario in which an impact or other force may be applied to the control panel 302. In FIG. 3C, the control panel 302 has been removed from the mounting plate 306. Such removal may occur gracefully (e.g., by removing fasteners, etc.) or forcefully (e.g., by breaking fasteners, components, etc.). Regardless of the particular manner in which the control panel 302 is removed, the anti-tamper switch 346 may detect such removal. For instance, the anti-tamper switch 346 may include a mechanical switch that may expand once removed from contact with the mounting plate 306. In other embodiments the anti-tamper switch 346 may use a capacitive, magnetic, inductive, or other type of sensor, or some combination thereof, to detect removal. When removal is detected using the anti-tamper switch 346, a signal may be generated and potentially transmitted to a remote service center. The remote service center may then take appropriate action. Example actions are described in greater detail herein, but may include following-up with a user of the control panel, contacting emergency personnel, attempting to obtain an additional response from the control panel 302, or taking other action.

As further illustrated in FIG. 3C, when the control panel 302 is removed, the AC power supply 350*a* may also be disconnected. Disconnection of the AC power supply 350*a* may be approximately simultaneous with the removal of the control panel 302, but may also occur before or after removal. In some embodiments, removal of the control panel 302 as detected by the anti-tamper switch 346 and/or disconnection of the AC power supply 350*a* may trigger a signal to a remote service provider. In still other embodiments, signals may be generated in response to other events. For instance, the sensor 351 could detect a shock or impact to the body 303 of the control panel 302, loss of communication or functionality with the display 344 or other component, or some other event that may indicate the control panel 302 has been intentionally or unintentionally damaged.

Figure 3D:
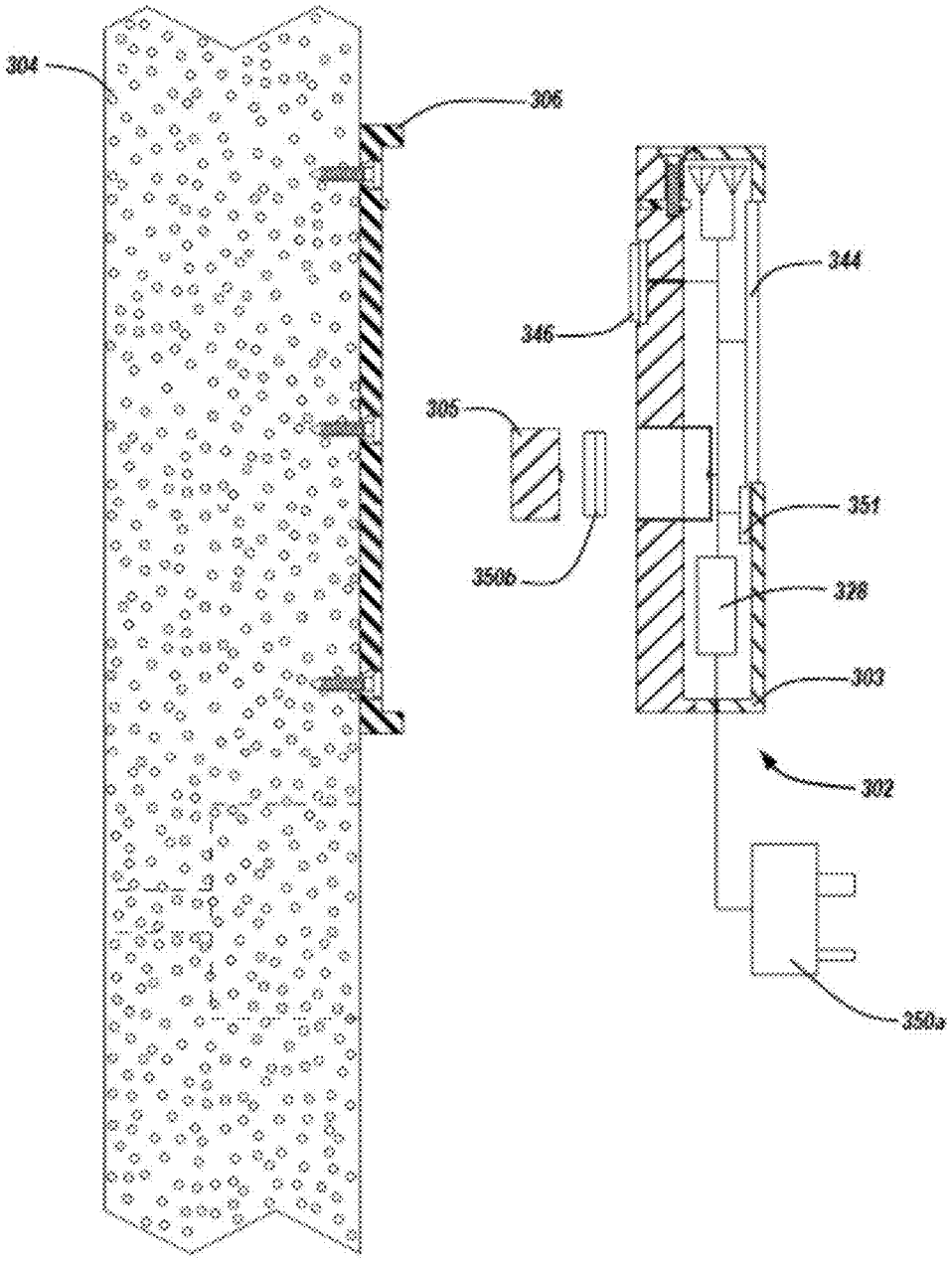

In the case where a control panel 302 is to be completely disabled (e.g., when an intruder performs a crash-and-smash entry), the intruder may want to also eliminate all power to the control panel 302. Accordingly, FIG. 3D illustrates an example embodiment in which the DC power supply 350*b* may also be removed. In this particular embodiment a door 305 may be formed in the body 303 of the control panel 302. By removing the door 305, a person may access and remove the DC power supply 350*b*. Of course, an intruder or other person intending to damage the control panel 302 could also apply a force to the body 303 to simply break the body 303. That damage may cause the DC power supply 350*b* to fall out of the control panel 302, may damage connections used to take advantage of the DC power supply 350*b*, may damage all components using the power from the DC power supply 350, or some combination thereof. In any such case, control panel 302 may experience a total loss of AC and DC power, and be totally disabled.

Figure 4:
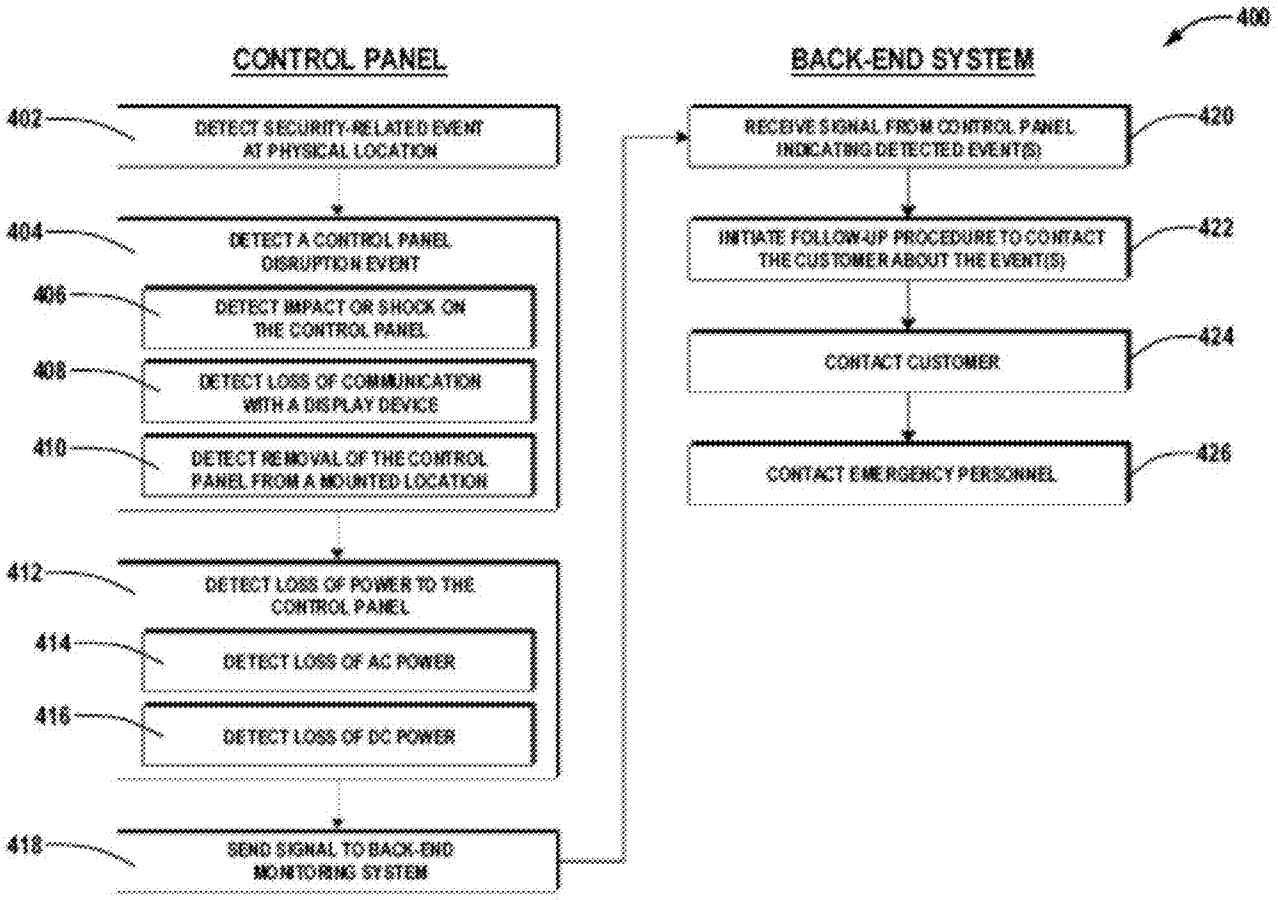
FIG. 4 illustrates an example method for detecting damage of a control panel, in accordance with some embodiments of the present disclosure.

As discussed herein, when the control panel 302 is damaged or disabled, the control panel 302 may make an attempt to notify a remote service system of the damage. The remote service system may determine if any action is warranted, and take, request, or initiate such action in cases where it is desired. FIG. 4 illustrates an example method 400 for detecting damage of the control panel 400. As also shown an described, the method 400 may also include notifying a remote service provider, such as a back-end system, and taking some action based on the report of damage.

More particularly, the method 400 may include an optional step of detecting a security-related event at a physical location 402. For instance, if a security system is armed, the security system may determine an unauthorized entry has occurred at a particular building or other location. The entry may be detected using one or more automation components, including sensors at a door, window, or other location, although any type of detection system may be used.

In the case of a crash-and-smash entry, an intruder may attempt to locate the control panel, and then damage the control panel. For such a case, the method 400 may also include a step 404 for detecting a control panel disruption event. As discussed herein, the disruption event may take any number of forms, and detection of the disruption event in step 404 may occur in any number of manners. For instance, FIG. 4 illustrates an example in which detecting the disruption event may include any of one or more detection events.

More particularly, FIG. 4 illustrates an example in which an act 406 of detecting an impact or shock on the control panel may be used to detect a disruption event. As discussed herein, a control panel may include or be attached to an accelerometer, shock sensor, or other device capable of detecting when an impact force is applied to the control panel. This may be used, for instance, to determine the control panel has been hit with an object. Such a sensor may also potentially sense other events, such as where the control panel has been dropped or inadvertently hit or damaged.

In some embodiments, detecting a disruption event at the control panel in step 404 may also, or alternatively, include an act 408 of detecting loss of communication with a component (e.g., a display device). A sensor may detect a display or other component has become inoperable or unresponsive (e.g., if the display screen is broken). The sensor may operate by attempting to communicate with the display, by monitoring communications between a controller and a display, or in any other manner. In yet another embodiment, an act 410 of detecting removal of the control panel from a mounted location may detect a control panel disruption event in step 404. For instance, as discussed herein, an anti-tamper switch may detect that a control panel has been ripped off a wall. Of course, the anti-tamper switch may also be able to detect removal when a user removes the control panel for another reason (e.g., to replace a battery, to repair or replace the control panel or a component, etc.). In some embodiments, the anti-tamper switch may detect any removal, whereas in other embodiments only some types of removal (e.g., a forceful removal) may be detected, or different types of removal may be differentiated using one or more sensors or switches.

In accordance with some embodiments of the present disclosure, the method 400 may include a step 412 for detecting loss of power to the control panel. As shown in FIG. 4, this step 412 may occur after detection of a control panel disruption event in step 404, and potentially in response to such an event. In other embodiments, detection of power loss events in step 412, and detection of a control panel disruption event in step 404 may be synchronous or occur in any order.

As discussed herein, a control panel of an automation system may use any number of types of power supplies. In some embodiments, the control panel may have a single power supply, whereas other control panels may use multiple power supplies. FIG. 4 therefore illustrates an example in which one or more types of power supplies may be monitored to detect when power is lost in step 412. More particularly, the method 400 includes an optional act of detecting when AC power is lost (act 414) as well as detecting when DC power is lost (act 416). Any suitable system or component may be used to detect when power is lost. For instance, a sensor may detect a disconnection between an AC power supply and an AC power source. Similarly, a sensor may detect when a DC power supply is present or removed. It should also be appreciated in view of the disclosure herein that other sensors or devices may be included, and that loss of other power may be detected. In some embodiments, for instance, rather than detecting loss of AC and DC power separately, detecting loss of power in step 412 may detect a total loss of power.

Following detection of a security-related event in act 402, a control panel disruption event in step 404, or a loss of power in step 412, or any combination of the foregoing, the control panel 418 may send a signal to a back-end monitoring system (act 418). Such a signal may include sufficient information to allow the back-end monitoring system to determine what event was detected.

When the control panel sends the signal in act 418, it should be appreciated that the signal may be sent immediately upon detection of an event (e.g., an event in act 402, step 404 or step 412), after a combination of events, or after some predetermined delay (e.g., an entry delay). For instance, the signal (or multiple signals) of a particular type or content may be sent in some embodiments only where control panel is disrupted and where there is a loss of some or all power. In other events, any event alone may be enough to trigger sending of an event in act 418.

Further, for situations such as a crash-and-smash entry, there may not be much time between when an event is detected, and when the control panel is completely disabled. If a signal is not sent immediately, there may be little or no time to send the signal. In such a case, delay in sending the message may result in not notifying the back-end monitoring system of a particular event. To expedite sending of signals in act 418, components may therefore be selected and configured to send signals quickly. For instance, a shock sensor may detect an impact force above a predetermined threshold, and immediately send a signal. Some delay may occur between when the impact is felt and when the control panel is completely disabled, so the signal may be able to be sent and reach its destination. Similarly, components to detect loss of some power may also act immediately to send a signal in act 418 in the event any power is lost. Thus, if AC power is lost, DC power may be immediately used to send a signal to that effect, and vice versa.

Where the control panel sends the signals in act 418 immediately upon sensing an event (e.g., an impact or other disruption to the control panel), the time to completely send the signal may vary based on the components. In at least one embodiment, the time between starting to sense a disruption and sending of the signal is less than one second. In other embodiments, the time may be approximately half a second. In a more particular embodiment, the time between detecting the disruption and sending the signal may be up to approximately 250 ms, up to approximately 100 ms, up to approximately 50 ms, or up to approximately 10 ms. Of course, in other embodiments, the time between detecting an impact or other disruption event and sending of the signal may be less than approximately 10 ms, or greater than 1 second. Moreover, in at least some embodiments, the delay may vary based on the type of disruption that is sensed. As an example, an impact with a force above a first predetermined threshold may result in immediately sending the signal, whereas a force larger than a second predetermined threshold, but less than the first predetermined threshold may include some delay. The delay may allow the control panel to continue to monitor activities of the control panel (e.g., power, communication with a display, additional impacts, etc.) prior to sending the initial signal.

As shown in FIG. 4, the method 400 may include an additional method, or set of acts, to be employed by the back-end monitoring system. These acts may include an act 420 of receiving the signal from the control panel. Receipt of the signal in act 420 may also include interpreting the signal, which signal can identify the disruption event, power loss, security-related event, or other event, or some combination thereof. In some cases, the back-end monitoring system may interpret the signal received in act 420 and determine that some action is warranted. Such action may occur due to the detected security-related event, the detected control panel disruption event, the detected loss of power, or any combination of the foregoing. Indeed, in some embodiments, different actions may be applied based on what events are detected and supplied by the received signal, or what combination of events are detected.

In at least some embodiments, the back-end monitoring system may initiate a follow-up procedure to contact the customer about one or more events that are detected by the control panel (act 422). As noted herein, one type of situation where events are detected may include a so-called crash-and-smash entry. In that type of scenario, the control panel may be damaged or ripped from a wall, which may potentially disable one or more power sources to the control panel. In that case, the follow-up procedure may include contacting the customer (act 424). For instance, a message may be sent through an electronic communication system of the back-end monitoring system, to request that a customer service representative make or conduct a phone call; although an email, text message, or other type of follow-up may be made. When contacting the customer in act 424, details may potentially be obtained to determine if there was an intruder, whether there was a false alarm, or whether something else happened. Indeed, in some cases the control panel could be damaged inadvertently, but follow-up with the customer may allow a service provider to quickly respond and potentially replace the control panel or schedule a service call for repair or other service. In some embodiments, there may be sufficient concern that an intruder has entered a building or other location, and the method 400 may also include the back-end monitoring system contacting emergency personnel (act 426), or initiating such contact, such as by notifying a customer service representative of a potential problem, and having the customer service representative call or otherwise contact the police, security, or other emergency responder.

It should be appreciated in view of the disclosure herein that the method 400 may be altered in any number of manners, or may be implemented in a variety of contexts. Thus, while a crash-and-smash entry may be one type of event where the method 400 is performed, the method 400 may be performed at other times, and in response to other events, that may or may not be emergency or security-related concerns.

Indeed, some embodiments contemplate the method 400, or components thereof, being performed regardless of whether a security system or other automation system is armed. In FIG. 4, the act 402 may detect a security event potentially prior to detecting a control panel disruption event in step 404. This may occur where the security system is armed. If, however, the security system is not armed, the act 402 may not occur. Instead, the method 400 may begin by detecting another event (e.g., power loss, damage or impact to the control panel, etc.). Thus, the method 400 can be useful regardless of whether or not an automation service is monitoring a particular system (e.g., whether an alarm is turned on).

The method 400 may also include additional or other acts. For instance, in the context of a security system that is destroyed, an intruder may smash the control panel before detection can be made as to whether power was lost. A signal about the disruption event detected in step 404 may, however, still be sent in act 418. The back-end monitoring system may expect to receive both disruption information and power information. If information about power (e.g., whether power is or is not available) is not received within a particular time period, the back-end monitoring system may assume that the control panel has lost all power. Thus, the step 412 of detecting loss of power to the control panel may be performed by the back-end monitoring system. In other embodiments, the back-end monitoring system may send a signal to the control panel. If no response is received, the back-end monitoring system may assume all power has been lost and the control panel is disabled.

It should further be appreciated in view of the disclosure herein that embodiments of the present disclosure may also be used in connection with other systems, methods, and components. For instance, an automation system may detect a security-related event in act 402 and immediately send a signal to the back-end monitoring system. The back-end monitoring system may then wait for an entry period to see if a signal is received indicating that a user has disarmed the automation system. If no such signal is received, an alarm may be sounded or other actions (e.g., acts 422-426) may occur. Of course, waiting for the disabling signal may be bypassed if control panel disruption events and/or power loss are detected.

In view of the above description, it should be appreciated that systems, control panels, devices, and methods of the present disclosure may allow for detection of security-related events, including potential damage to a control panel (whether or not intentional, and whether or not also occurring with an additional security-related event). By monitoring whether the control panel is removed, damaged or subjected to an impact force, the systems, devices, and methods may detect such events and respond. An example response may include initiating follow-up by notifying a customer service representative of one or more events. In response to the notification, a customer service representative may call or otherwise contact the customer to determine what is happening and determine if there is a security-related threat, whether there is a false alarm, whether there is a problem with the control panel, or whether some other event has occurred. Such a call may be made manually, or may be auto-dialed for the customer service representative.

When the call is made, a problem may be remedied in a timely manner. For instance, if there is a security-threat, a call may be made to an emergency responder such as the police or security. If the control panel was inadvertently damaged, a service call may be scheduled or replacement parts may be sent. If the control panel is being removed and replaced with a competitive system, the customer service system may attempt to retain the customer before a competitive system is installed to improve the likelihood of retaining the customer.

Embodiments of the present disclosure may comprise or utilize a special purpose or general-purpose computer including computer hardware, such as, for example, one or more processors and system memory in a control panel for an automation system, a server or computing device of a network operations center or monitoring system, or in other systems or components. Embodiments within the scope of the present disclosure also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media. Computer-readable media that carry computer-executable instructions are transmission media. Thus, by way of example, and not limitation, embodiments of the disclosure can comprise at least two distinctly different kinds of computer-readable media, including at least computer storage media and/or transmission media. Computer-readable media that includes computer-executable instructions may also be referred to as a computer program product.

Examples of computer storage media include RAM, ROM, EEPROM, CD-ROM or other optical disk storage, magnetic disk storage or other magnetic storage devices, flash-based storage, solid-state storage, or any other physical, non-transmission medium which can be used to store desired program code means in the form of computer-executable instructions or data structures and which can be accessed by a general purpose or special purpose computer.

When information is transferred or provided over a communication network or another communications connection (either hardwired, wireless, or a combination of hardwired or wireless) to a computing device, the computing device properly views the connection as a transmission medium. A "communication network" may generally be defined as one or more data links that enable the transport of electronic data between computer systems and/or modules, engines, and/or other electronic devices, and transmissions media can include a communication network and/or data links, carrier waves, wireless signals, and the like, which can be used to carry desired program or template code means or instructions in the form of computer-executable instructions or data structures within, to or from a communication network. Combinations of storage media and transmission media should also be included within the scope of computer-readable media.

Further, upon reaching various computer system components, program code means in the form of computer-executable instructions or data structures can be transferred automatically from transmission media to storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media may be included in computer system components that also (or even primarily) utilize transmission media.

Computer-executable instructions comprise instructions and data which, when executed at a processor, cause a general purpose computer, dedicated or special purpose computer (e.g., an automation system control panel), or special purpose processing device to perform a certain function or group of functions. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above, nor performance of the described acts or steps by the components described above. Rather, the described features and acts are disclosed as example forms of implementing the claims.

Those skilled in the art will appreciate that the embodiments may be practiced in network computing environments with many types of computer system configurations, including, personal computers, desktop computers, laptop computers, message processors, hand-held devices, programmable logic machines, multi-processor systems, microprocessor-based or programmable consumer electronics, network PCs, tablet computing devices, minicomputers, automation system control panels, network operations centers, mainframe computers, mobile telephones, PDAs, pagers, routers, switches, and the like.

Embodiments may also be practiced in distributed system environments where local and remote computer systems, which are linked (either by hardwired data links, wireless data links, or by a combination of hardwired and wireless data links) through a network, both perform tasks. In a distributed computing environment, program modules may be located in both local and remote memory storage devices.

Those skilled in the art will also appreciate that embodiments of the present disclosure may be practiced in special-purpose, dedicated or other computing devices integrated within or particular to a particular residence, business, company, government agency, or other entity, and that such devices may operate using one or more network, wireless, hardwire, or other connections, or any combination thereof. Examples may include residential or commercial buildings in connection with security or other automation systems configured to monitor local conditions (i.e., within a specific range of the building), remote conditions (i.e., accessible regardless whether within a particular range), or some combination thereof.

Although the foregoing description contains many specifics, these should not be construed as limiting the scope of the disclosure or of any of the appended claims, but merely as providing information pertinent to some specific embodiments that may fall within the scopes of the disclosure and the appended claims. Various embodiments are described, some of which incorporate differing features. Any feature illustrated or described relative to one embodiment is interchangeable and/or may be employed in combination with features of any other embodiment herein. No element, component, act, or step is necessarily or required unless specifically recited as required for all embodiments disclosed herein. Methods described include acts or steps that may be performed in any order. Additionally, disclosed methods may be considered as multiple methods when actions are taken place by different personnel, systems, or components. Other embodiments may be devised which lie within the scopes of the disclosure and the appended claims. The scope of the disclosure is, therefore, indicated and limited only by the appended claims and their legal equivalents. All additions, deletions and modifications to the disclosure, as disclosed herein, that fall within the meaning and scopes of the claims are to be embraced by the claims.

What is claimed is:

1. A method of monitoring a condition of a control panel of a security system, comprising:

detecting, based at least in part on using at least one of an impact sensor, an anti-tamper switch, or an accelerometer, a control panel disruption event at the control panel; and comparing a value associated with the control panel disruption event with a plurality of thresholds;

delaying a sending of a signal indicative of the control panel disruption event for a varying amount of time based at least in part on the comparing; and sending the signal to a back-end monitoring system based at least in part on the delaying.

2. The method of claim 1, wherein detecting the control panel disruption event is based at least in part on using the accelerometer and comprises:

measuring a force detected by an accelerometer associated with the control panel;

classifying the force measured by the accelerometer;

categorizing the control panel disruption event at the control panel.

3. The method of claim 1, wherein detecting the control panel disruption event is based at least in part on using the anti-tamper switch and comprises:

determining that the anti-tamper switch has been activated.

4. The method of claim 3, wherein determining that the anti-tamper switch has been activated comprises:

determining that the control panel has been removed from a mounting surface, a mounting plate, or both.

5. The method of claim 1, wherein detecting the control panel disruption event is based at least in part on using the impact sensor comprises:

detecting an impact force on the control panel.

6. The method of claim 1, wherein the signal indicative of the control panel disruption event comprises a first signal, and further comprising:

determining whether the control panel has lost power; and sending to the back-end monitoring system a second signal, wherein the second signal is indicative of whether the control panel of an automation system has lost power.

7. The method of claim 6, further comprising:

determining at least one of whether the control panel has lost primary power or has lost secondary power;

wherein the second signal is based at least at in part on the determining at least one of whether the control panel has lost primary power or has lost secondary power.

8. The method recited in claim 7, wherein the primary power is associated with an alternating current (AC) power supply and the secondary power is associated with a direct current (DC) power supply.

9. The method recited in claim 7, wherein determining at least one of whether the control panel has lost primary power or secondary power comprises;

determining that the control panel has lost primary power and determining that the control panel has not lost secondary power; and wherein sending the signal indicative of whether the control panel of the automation system has lost power comprises:

using the secondary power.

10. The method of claim 6, wherein the at least one of the impact sensor, the anti-tamper switch, or the accelerometer comprises at least a first sensor, and the determining whether the control panel has lost power is based at least in part on a second sensor.

11. The method of claim 1, further comprising:

monitoring a status of the security system, wherein the status of the security system includes at least one of being armed or disarmed.

12. The method of claim 11, further comprising:

determining, based at least in part on the monitoring, that the status of the security system is armed when the control panel disruption event was detected; and wherein, based at least in part on the determining that the status of the security system is armed, the sending the signal indicative of the control panel disruption event occurs immediately upon the detecting the control panel disruption event.

13. The method of claim 12, further comprising:

sending, to the back-end monitoring system, an indication that the status of the security system was armed when the control panel disruption event was detected.

14. The method of claim 1, wherein the detecting the control panel disruption event is based at least in part on using the accelerometer and comprises measuring a force detected by an accelerometer associated with the control panel; and wherein the delaying the sending the signal indicative of the control panel disruption event is for a period of time related to the measured force.

15. The method of claim 1, wherein the detecting the control panel disruption event is based at least in part on using the impact sensor and comprises detecting an amount of impact force; and wherein the delaying the sending the signal indicative of the control panel disruption event is for a period of time related to the detected amount of impact force.

16. A control panel for a security system, comprising:

a controller;

a communication interface communicatively connected to the controller;

a sensor configured to monitor a status of the control panel, wherein the sensor comprises at least one of an impact sensor, an anti-tamper switch, or an accelerometer; and computer readable media having computer executable instructions stored thereon that, when executed by the controller, cause the communication interface to:

compare a value associated with a control panel disruption event with a plurality of thresholds;

delay a sending of a signal indicative of the control panel disruption event for a varying amount of time based at least in part on the comparing; and transmit the signal upon delaying the signal indicative of the control panel disruption event.

17. A method, comprising:

at a service system remote from a control panel of a security system, monitoring a status of the control panel;

receiving a delayed signal from the control panel, wherein the delayed signal is delayed for a varying amount of time based at least in part on comparing a value associated with a disruption event at the control panel with a plurality of thresholds;

interpreting the delayed signal as indicative of the control panel having detected, using at least one of an impact sensor, an anti-tamper switch, or an accelerometer, the disruption event at the control panel itself; and determining that the disruption event is indicative of a crash-and-smash entry.

18. The method of claim 17, further comprising:

selecting a follow-up procedure based at least in part on the determining that the disruption event is indicative of the crash-and-smash entry;

initiating an action to implement the selected follow-up procedure.

* * * * *